US007438489B2

(12) United States Patent
Fujii

(10) Patent No.: US 7,438,489 B2
(45) Date of Patent: Oct. 21, 2008

(54) COATING FILM TRANSFER TOOL

(75) Inventor: Keisuke Fujii, Osaka (JP)

(73) Assignee: Fujicopian Co., Ltd., Osaka-shi (JP)

( * ) Notice: Subject to any disclaimer, the term of this patent is extended or adjusted under 35 U.S.C. 154(b) by 331 days.

(21) Appl. No.: 11/363,804

(22) Filed: Feb. 28, 2006

(65) Prior Publication Data

US 2006/0198685 A1 Sep. 7, 2006

(30) Foreign Application Priority Data

Mar. 4, 2005 (JP) ..... 2005-060599
Nov. 18, 2005 (JP) ..... 2005-334438

(51) Int. Cl.
*B41J 11/60* (2006.01)
*B41J 29/00* (2006.01)
*B41J 29/36* (2006.01)
*B41F 35/00* (2006.01)

(52) U.S. Cl. ..... 400/697; 400/702

(58) Field of Classification Search ..... 400/695, 400/697, 697.1, 700, 701, 702; 118/74, 76, 118/200, 257; 401/13, 16, 17, 20, 29, 31; 156/277, 579; 242/588.3
See application file for complete search history.

(56) References Cited

U.S. PATENT DOCUMENTS 2,905,147 A 9/1959 Johmann
6,065,887 A * 5/2000 You ..... 400/697
6,905,545 B2 * 6/2005 Tominaga ..... 118/76
2006/0257195 A1 11/2006 Chen

FOREIGN PATENT DOCUMENTS

| | | | |
|---|---|---|---|
| DE | 198 24 552 A1 | | 6/1998 |
| JP | 2-47357 | | 10/1990 |
| JP | 10-119488 | | 5/1998 |
| JP | 2002-283795 | | 10/2002 |
| JP | 2004130746 A | * | 4/2004 |
| JP | 2004-216837 | | 8/2004 |
| JP | 2004216837 A | * | 8/2004 |

* cited by examiner

*Primary Examiner*—Anthony H. Nguyen
*Assistant Examiner*—Leo T Hinze
(74) *Attorney, Agent, or Firm*—Howson & Howson LLP

(57) ABSTRACT

In a coating film transfer tool, a cassette including a tape supply reel, a transfer head, and a take-up reel, is removably disposed in a case. The cassette is approximately symmetric, and can therefore be installed it the case in either of two alternative positions. An alternate action push-button mechanism is provided for extending and withdrawing the transfer head. The cassette includes a mechanism for reducing the inter-axis distance between the supply and take-up reels to prevent, or at least reduce, the increase in tension on the tape as the tape supply is depleted.

6 Claims, 7 Drawing Sheets

COATING FILM TRANSFER TOOL

CROSS-REFERENCE TO RELATED APPLICATIONS

This application claims priority from Japanese patent application No. 334438/2005, filed Nov. 18, 2005, and Japanese patent application No. 60599/2005, filed Mar. 4, 2005. The disclosures of both of these two Japanese patent applications are hereby incorporated by reference.

FIELD OF THE INVENTION

This invention relates to coating film transfer tools, which transfer a film to a receiving surface for correction of written matter, for the application of an adhesive, for decorative coating, for marking, or for various other purposes. In a typical coating film transfer tool, a base tape wound on a supply reel extends past a transfer head to a take-up reel. The base tape on the supply reel has a coating, which is transferred to the receiving surface as the base film is pressed against the receiving surface by the transfer head.

BACKGROUND OF THE INVENTION

In some conventional coating film transfer tools, a removable cap is used to protect the transfer head. However, attachment and detachment of the cap is bothersome, and the cap can easily become lost when detached.

One way to avoid the problem of the removable cap is to incorporate a sliding protector tube in the case of the transfer tool. When the transfer tool is not in use, the tube can be moved out of the case to a position in which it surrounds and protects the transfer head. A transfer tool incorporating a sliding protector tube is disclosed in Unexamined Japanese Patent Publication No. 119488/1998.

Another way to avoid the problem of the removable cap is to make the transfer mechanism retractable, so that the transfer head, which is part of the transfer mechanism can protrude from a case for use, but can be withdrawn into the case when the tool is not in use. The transfer head can be made to protrude by manual depression of a button on the proximal end of the case, and can be released for withdrawal into the case by depression of a separate button on the side of the case. A transfer tool incorporating a retractable transfer mechanism is disclosed in Unexamined Japanese Patent Publication No. 2004-216837.

These two previously proposed solutions to the problem of the removable cap have their own problems.

Unless careful measures are taken, the sliding protector tube can accidentally slide into the case, even when exposure of the transfer head is not intended, thereby exposing the transfer head and the transfer tape to possible damage, and allowing unwanted transfer of coating film from the tape to occur. Likewise, the protector tube can accidentally slide to its transfer head-protecting position while the device is in use, interfering with proper operation of the transfer device.

The transfer tool having a retractable transfer mechanism can avoid, or at least significantly reduce, the likelihood of accidental exposure of the transfer head and accidental interference with the proper operation of the transfer tool. However, it is structurally more complicated, and its operation becomes complicated, since the operating buttons are located separately from each other.

Other problems are encountered in conventional coating film transfer tools. For example, in most coating film transfer tools of the type utilizing a replaceable cassette for replenishing the transfer tape supply, the replacement cassette can be loaded in only one position, and therefore, careful attention is required for proper replacement of the transfer tape supply.

Another common problem is that, since the outer diameter of the transfer tape wound around the supply reel decreases as the transfer tool is used, the tensile force required to draw the transfer tape from the supply reel increases. Therefore, in the later stages of use, the pressing force applied, through the tape, by the transfer head against the receiving surface must be increased, making it difficult to accomplish smooth and reliable transfer of the coating film.

In view of the above problems, the principal object of the invention is to provide a coating film transfer tool in which the transfer head can be easily and reliably shifted from a protected position to a position for use. An object of another aspect of the invention is to all the transfer tape to be drawn from the supply reel without application of an excessive pressing force, even when the tape supply approaches depletion.

SUMMARY OF THE INVENTION

The coating film transfer tool according to the invention comprises a cassette having a supply reel, a transfer head and a take-up reel. The supply reel holds a supply of transfer tape composed of a base tape having a coating film thereon. The transfer head is pressed against the base tape to transfer the coating film from the base tape to a receiving surface. The base tape is wound onto the take-up reel after the coating film has been transferred from the base tape.

Means are provided for interconnecting the supply and take-up reels and driving the take-up reel in a direction to wind base tape thereon as transfer tape is unwound from the supply reel. The cassette is contained in a case having a forward end and a rear end, and is movable, when contained in the case, both forward and rearward along a longitudinal direction extending from the forward end to the rear end of the case. The forward end of the case has an opening through which the transfer head can protrude when the cassette is moved forward, and into which the transfer head can be withdrawn when the cassette is moved rearward. The cassette is biased rearward by a suitable biasing means, preferably a coil spring. Means, operable by depression of a push button protruding from the rear end of the case, are provided for moving the cassette forward and latching the cassette in a first position in which the transfer head protrudes through the opening, and for allowing the biasing means to move the cassette to a second position, in which the transfer head is withdrawn into the opening. The cassette is movable to its first and second positions respectively by alternate depressions of the push button.

In a preferred embodiment, the cassette is replaceable, and is approximately symmetrical in a widthwise direction perpendicular to the longitudinal direction extending from the forward end to the rear end of the case.

In accordance with another aspect of the invention, the supply and take-up reels are rotatable, on the cassette, on spaced axes, and the interconnecting and driving means comprises an endless belt extending from the supply reel to the take-up reel, the belt being in tension, in driven relationship with the supply reel, and in driving relationship with the take-up reel. Means are provided for allowing the spacing of the axes of the supply and take-up reels to be shortened by a reaction force in reaction to pressure applied by the transfer head, through the transfer tape, to a receiving surface, so that, when the spacing of the axes is shortened, tension in the belt is reduced. The reduction in the tension of the belt allows some slippage to occur in the drive, mechanism, thereby reducing the retarding force acting on the length of tape between the supply reel and the transfer head, especially when the diameter of the roll of tape on the supply reel decreases as the supply of tape approaches depletion.

In a preferred embodiment, the cassette comprises a support frame, the supply and take-up reels are mounted on different parts of the support frame the parts being connected by at least one deformable elastic member. The spacing of the axes of the supply and take-up reels is shortened by elastic deformation of the deformable elastic member.

Among the advantages of the invention are the fact that the transfer head can be made to protrude from the case, and can be withdrawn into the case, by successive depressions of a single button. Therefore, the transfer tool is simple, and easy to use. In addition, since the cassette can be replaced, the case can be reused and waste of material is reduced. Moreover, since the cassette can be loaded into a case when in either of two alternative orientations, replacement of the cassette is easier to accomplish. Finally, when the outer diameter of the supply of transfer on a supply reel becomes small as the tape supply is depleted, the inter-axis distance shortening mechanism allows the transfer tape to be drawn from the supply reel without exerting an excessive pressing force against the tape through the transfer head.

BRIEF DESCRIPTION OF THE DRAWINGS

FIG. 2(*b*) is a top plan view of the transfer tool of FIG. 2(*a*);

FIG. 2(*c*) is cross-sectional view taken on plane 2*c*-2*c* of FIG. 2(*b*);

FIG. 3(*b*) is a top plan view of the transfer tool of FIG. 3(*a*);

FIG. 3(*c*) is cross-sectional view taken on plane 3*c*-3*c* of FIG. 2(*b*);

FIG. 4(*b*) is an exploded axial cross-sectional view of the elements of FIG. 4(*a*);

FIG. 5(*b*) is a side elevational view of the mechanism of FIG. 5(*a*);

FIG. 5(*c*) is an outside elevational view of a case incorporating the mechanism of FIGS. 5(*a*) and 5(*b*);

FIG. 6(*b*) is a side view of the cover of FIG. 6(*a*);

FIG. 6(*c*) is an outside elevation of the cover of FIG. 6(*a*); and

DETAILED DESCRIPTION OF THE PREFERRED EMBODIMENT

In the coating film transfer tool of the invention, the advancing and retracting operations of the transfer head are achieved by an alternate action push-button mechanism, sometimes referred to as a "double knocking mechanism." Such mechanisms are utilized in capless, retractable, ball-point pens such as those disclosed in Japanese Patent Publication 47357/1990. In the case of a capless, retractable, ball-point pen, a button at the proximal end of the pen is pushed once to cause a writing tip to protrude from the distal end of the pen, and pushed once again to allow the writing tip to be withdrawn into the body of the pen by the action of a spring.

Figure 1:
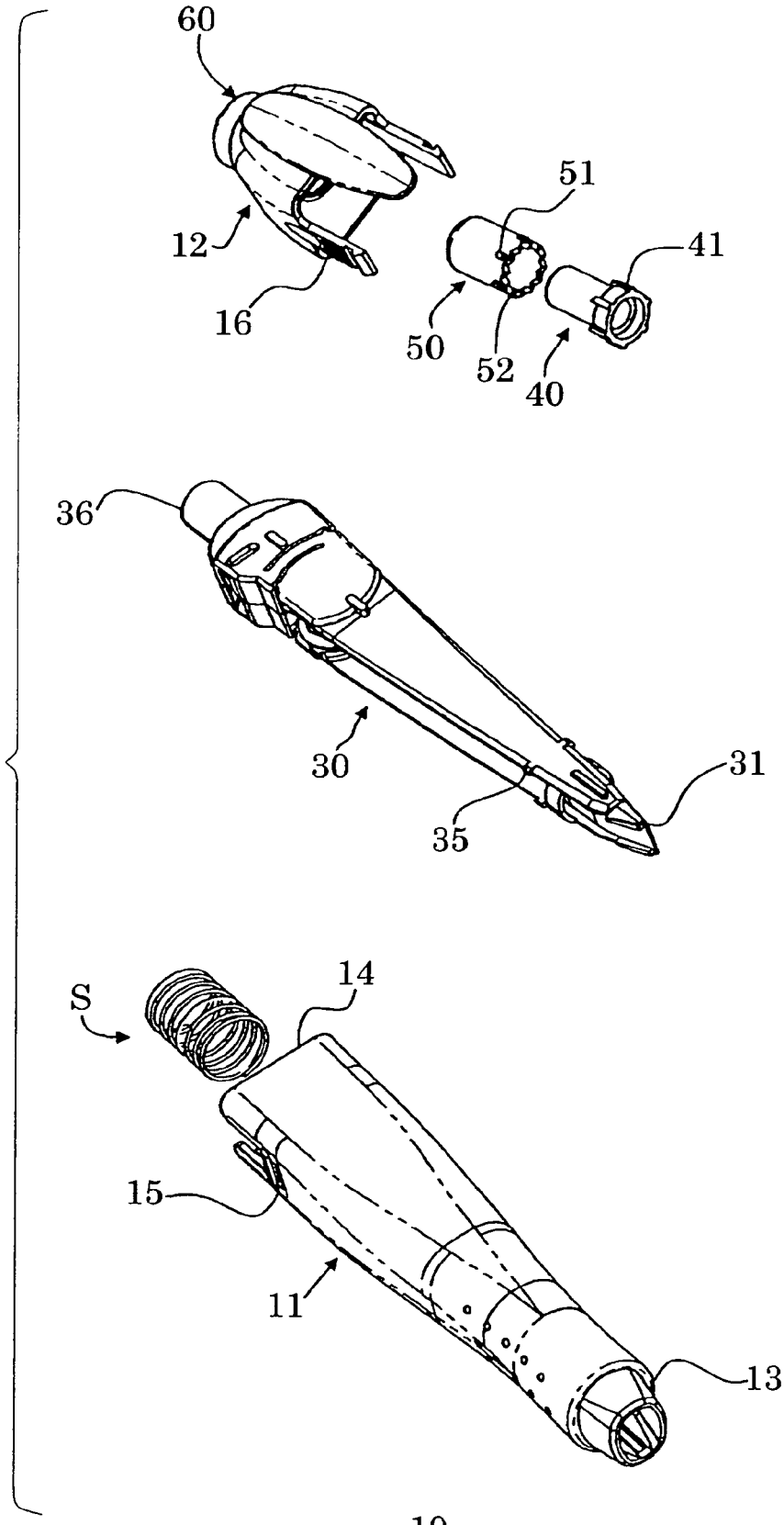
FIG. 1 is an exploded perspective view of a coating film transfer tool according to the invention.

As shown in FIG. 1, the coating film transfer tool 10 comprises a hollow case body 11 having openings 13 and 14 at its front and rear ends respectively, a case cover 12, a coil spring S, a cassette 30 having a transfer head 31, a rotary member 40, and a push button 50. A cylindrical guide 60, through which the push button 50 protrudes, is formed in the case cover 12.

Figure 2:
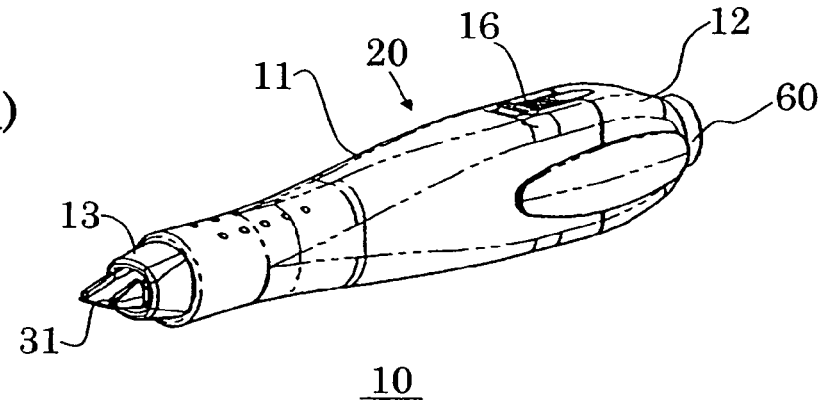
FIG. 2(*a*) is a perspective view showing the coating film transfer tool with its transfer head protruding.
Figure 2:
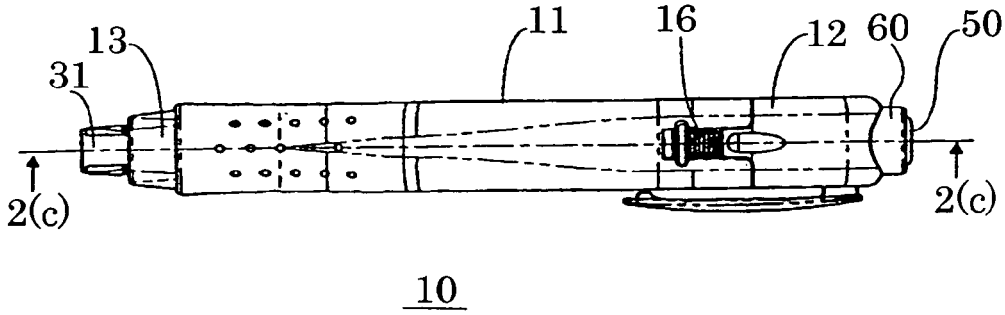
Figure 2:
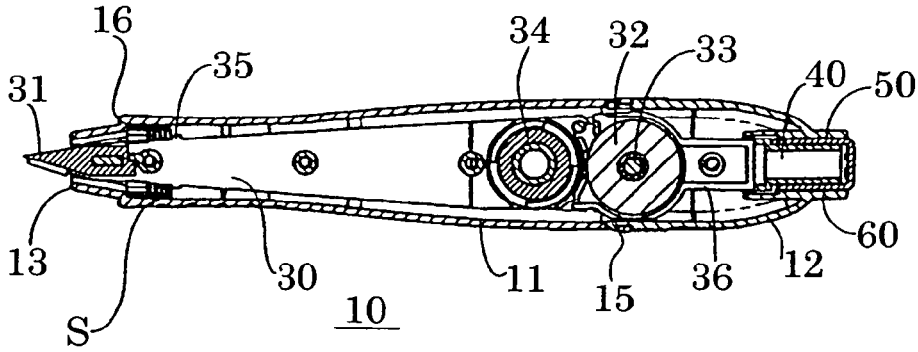

The cover 12 can be removably connected to the case body 11 by connecting resilient prongs 16, which are formed as a unitary part of the cover 12, to mating parts 15 on the case body 11, to form a case 20, as shown in FIGS. 2(*a*) and 3(*a*). The cassette 30 can be disposed inside the case 20, and can be removed from the case for replacement by disengaging the cover 12 from the case body 11. The cassette is movable longitudinally in the case, through a limited distance, along a direction extending from the front of the case, where the opening 13 is located to the rear of the case where the push-button 50 is located.

As shown in FIGS. 2(*a*), 2(*b*) and 2(*c*), the cassette can be in a position, within the case, in which the transfer head 31 can protrude through the opening 13. As seen in FIG. 2(*c*), the cassette 30 comprises a reel 33 on which a supply of transfer tape 32 is wound. The transfer tape is composed of a base tape having a coating in the form of a film, which can be transferred onto a receiving surface when the coated base tape is pressed against the receiving surface by the transfer head 31. The cassette also has a take-up reel 34, onto which the base tape is wound after the tape passes over the transfer head. The two reels are cooperatively connected in driving relationship by a driving mechanism (not shown), so that, as the transfer tape is drawn from the supply reel 33, causing the supply reel to rotate, the take-up reel 34 also rotates, and the base tape, from which the coating has been removed, is wound onto the take-up reel. The cassette can be loaded into to the case body 11 through its rear end opening 14 when the cover 12 is removed.

Figure 3:
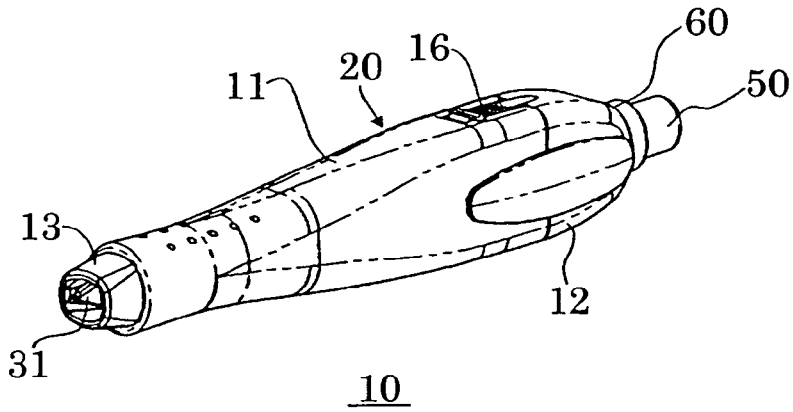
FIG. 3(*a*) is a perspective view showing the coating film transfer tool with its transfer head retracted.
Figure 3:
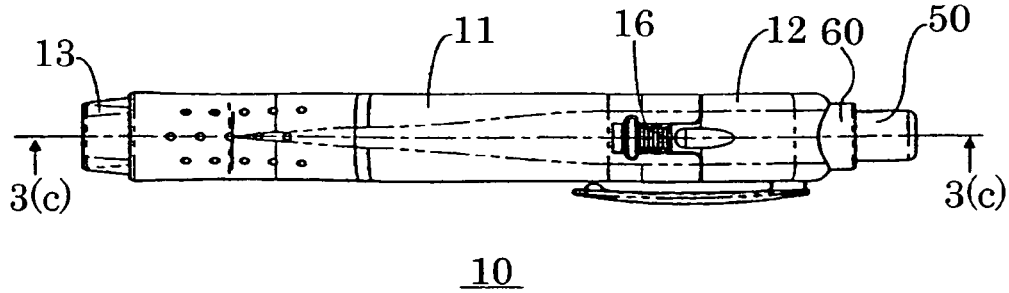
Figure 3:
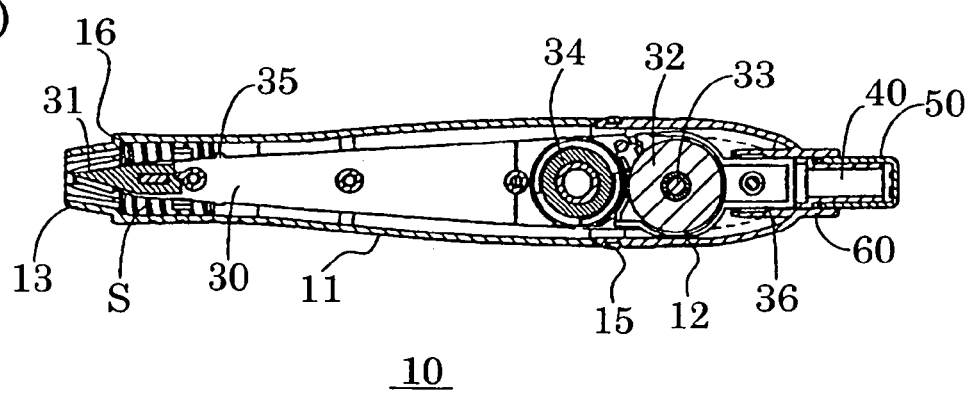

As shown in FIGS. 3(*b*) and 3(*c*), the push button 50 normally protrudes from the rear end of the case 20. As shown in exploded view in FIG. 4(*b*), the push button 50 can protrude through an opening 61 in cylindrical guide 60, and a rotary member 40 can be disposed between the cassette 30 and the push button 50. The rotary member 40, the push button 50, and the rear end of the cassette 30 fit loosely in the cylindrical guide 60, and are movable axially in the guide.

The coil spring S (FIG. 1(*c*)), fits between a stepped portion 16 on the inside of the case body 11 and a part formed on the rear of the cassette 30, biasing the cassette 30 in the retracting direction. The retracting force is exerted by the spring, through protrusion 36 at the rear end of the cassette, rotary member 40, and push button 50, either against the ends 64 of the longitudinal grooves 62 formed on the inside of guide cylinder 60, or against sawtooth-shaped cam teeth 63 formed on a stepped part 65 inside the guide cylinder, depending on whether the transfer head is in its protruding position or in its retracted position.

Figure 4:
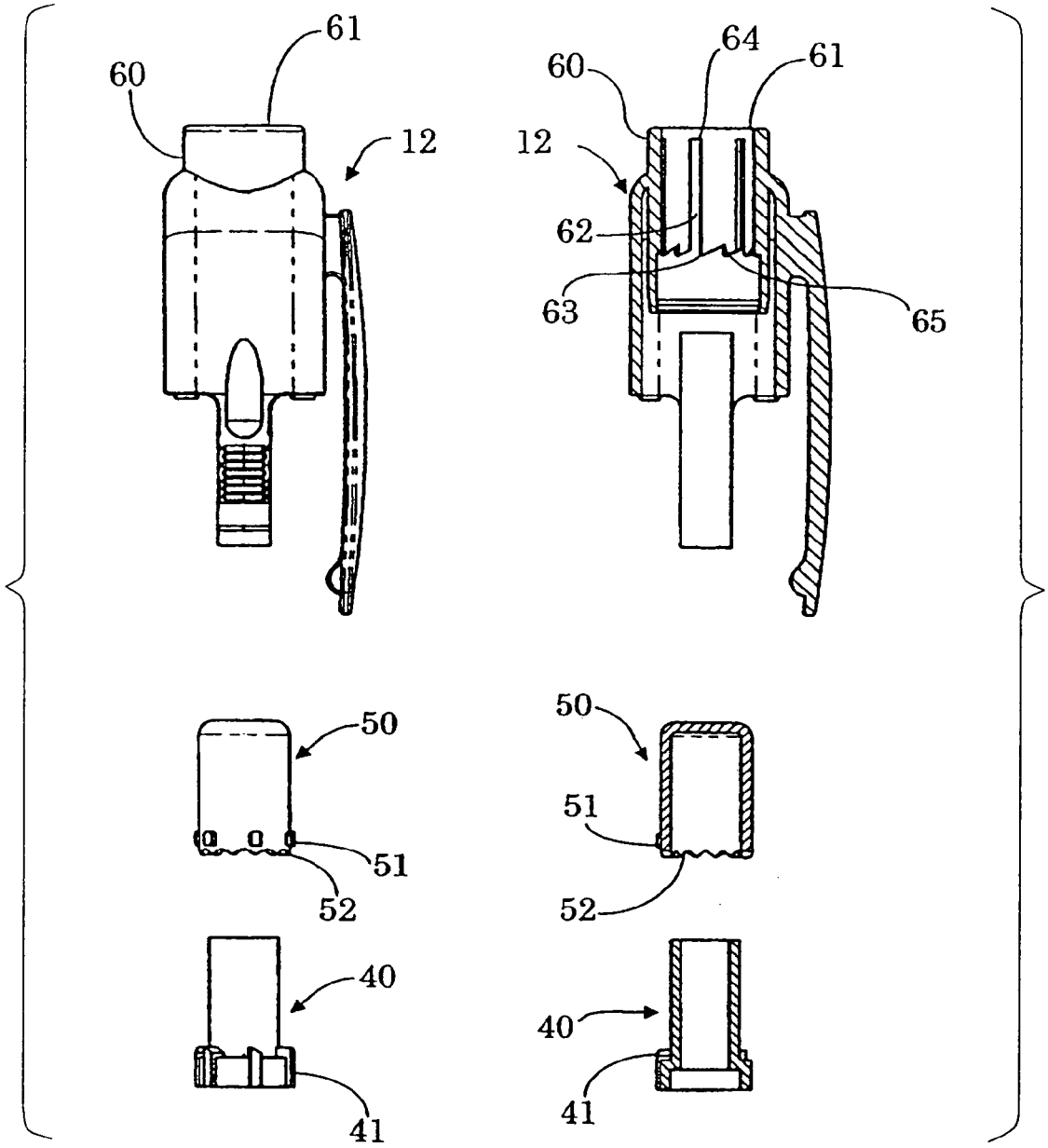
FIG. 4(*a*) is an exploded elevational of a case cover with an operating button, a guide cylinder, and a rotational member of the transfer tool according to the invention.

As shown in FIG. 4(*a*), the rotary member 40 has a set of projections 41 on its outer circumferential surface. The projections have slanted ends, adapted to engage the sloping parts of the teeth 63 on the inside of the guide. These projections also extend radially outward so that they can fit into the longitudinal grooves 62. The push button 50 has rotation-blocking projections 51 on its outer circumference, which also cooperate with longitudinal grooves 62 to prevent rotation of the push button. The push button also has cam teeth 52 at its lower edge, which cooperate with the slanted ends of projections 41 to effect rotation of the rotary member 40.

In the operation of the mechanism just described, when the transfer head is in its retracted condition, as depicted in FIGS. 3(*a*), 3(*b*) and 3(*c*), the radial projections 51 of the push button (FIGS. 4(*a*) and 4(*b*)) engage ends 64 of grooves 62. At the same time, projections 41 on the rotary member are disposed in grooves 62, and bear against sloping parts of the cam teeth 52 on the push button. That is, the projections 41 are not seated in cam teeth 52. When the push button is depressed a first time, it causes the projections 41 on the rotary member to clear the grooves 62. When the projections 41 clear the grooves, and the manual pushing force on the push button is released, the cooperation between the teeth 63 and the slanted parts of the projection 41 causes the rotary member to rotate slightly so that the projections 41 become seated in the notches of the teeth 63 between adjacent grooves 62. When the projections 41 are seated on teeth 63, the cassette is held in a position in which its transfer head protrudes through the opening 13 of the case, as shown in FIGS. 2(*a*), 2(*b*) and 2(*c*).

When the push button 50 is depressed a second time, the teeth 52 of the push button engage the sloping parts of the projections 41 on the rotary member 40, pushing the projections 41 away from the teeth 63 on the inside of the guide cylinder, and at the same time effecting rotation of the rotary member by an amount sufficient to allow the peaks of the slanted parts of projections 41 to clear the peaks of teeth 63. When the manual pushing force on the push button is once again released, the slanted faces of projections 41 ride on the sloping parts of teeth 63, effecting further rotation of the rotary member 40, until the projections 41 drop into grooves 62, allowing the cassette to return to its retracted position.

Various forms of alternate action push-button mechanisms can be used in the invention as alternatives to the particular mechanism described above. For example, in the mechanism the projections on the push button can slide in grooves which are different from the grooves in which the projections on the rotary member slide.

When replacing the cassette 30, the prongs 16 on the cover 12 are pressed manually and thereby disengaged from their mating parts 15 on the case body 11. The cover 12 can then be removed from the case body, and the exhausted cassette 30 can be removed through the opening 14 of the case body and replaced with a fresh transfer film cassette.

As seen in FIG. 1, the cassette 30 is approximately symmetrical widthwise. Consequently, even if the cassette is inserted into the case body 11 upside down, the transfer tool can be operated satisfactorily, and the transfer head can be made to protrude and retract by alternate depressions of the push button 50. Therefore, cassette replacement can be accomplished more quickly than in the case of a conventional coating film transfer tool in which a replaceable cassette can be inserted in only one way.

The take-up reel 34 can be connected in driven relationship to the supply reel 33 by any of various mechanisms. However, a simple and widely used mechanism is a belt drive, in which an endless band of elastic material is stretched between pulleys on the respective reels. When such a belt drive is utilized, an inter-axis distance shortening mechanism 70, in accordance with another aspect of the invention, can be used relieve tension in the belt as the supply of tape on the supply reel becomes depleted, so that the tape can be drawn off the supply reel more easily, and transfer of coating film onto a receiving surface can continue smoothly without the need to apply excessive pressure to the tape through the transfer head.

Figure 5:
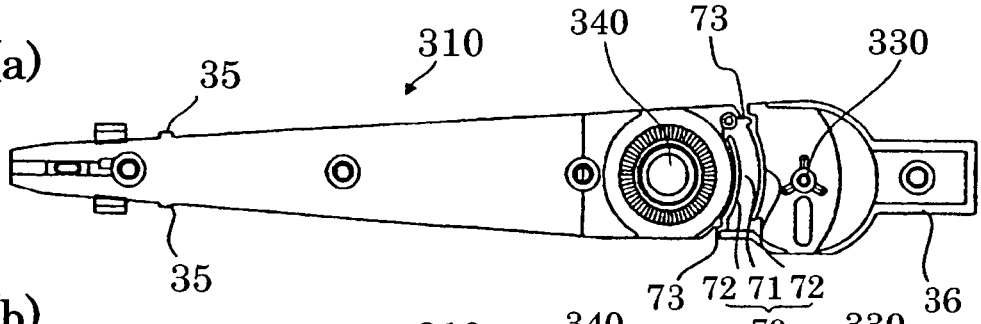
FIG. 5(*a*) is an inside elevational view of an inter-axis distance shortening mechanism in accordance with the invention.
Figure 5:
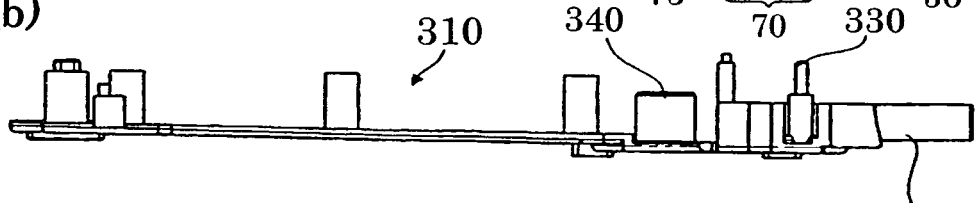
Figure 5:
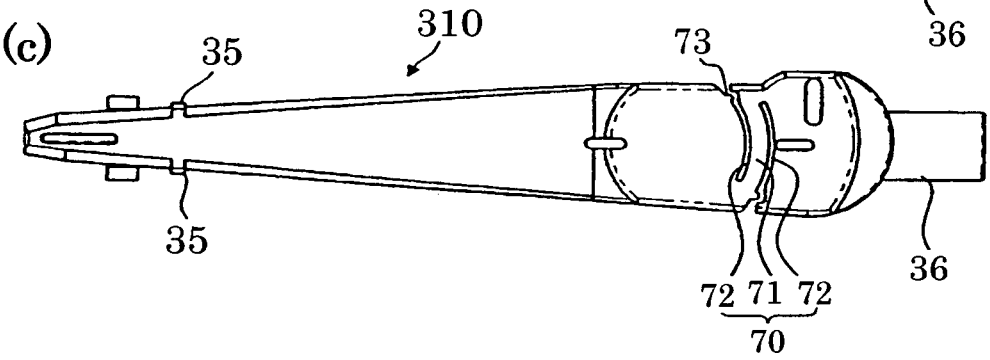
Figure 6:
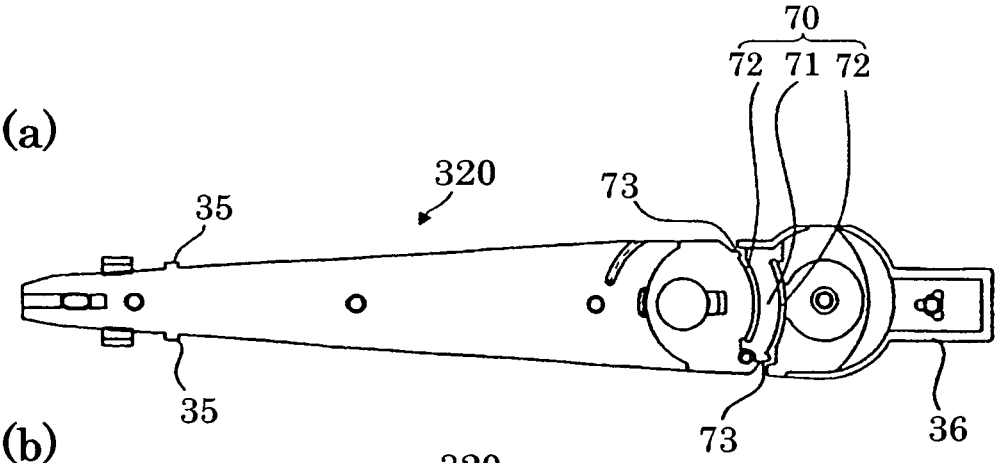
FIG. 6(*a*) is a inside elevation of a cover of a cassette in which an inter-axis distance shortening mechanism is set up.
Figure 6:
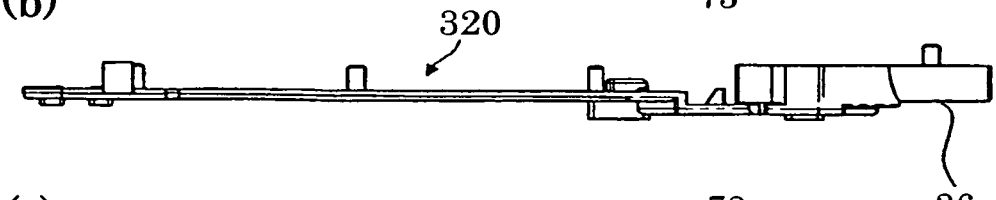
Figure 6:
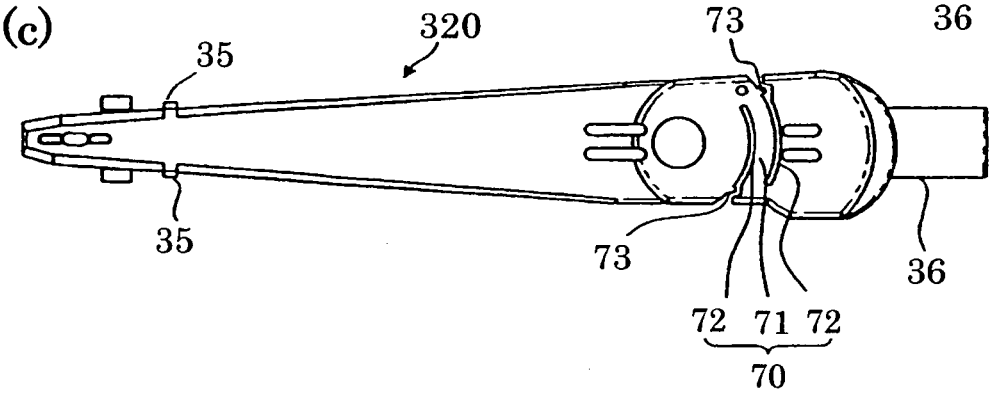

In the cassette according to the invention, the supply reel 33 and the take-up reel 34 are rotatably supported by a supply reel core 330 and a take-up reel core 340, respectively, as shown in FIGS. 5(*a*) and 5(*b*). In the assembly of the cassette, the transfer head 31 (FIG. 2(*c*)) is placed at the tip of the cassette part 310, and a cover 320 is united with the cassette part 310 by engaging each of a plurality of engaging parts. The part 310 and the cover 320 together form a cassette frame. Reels 33 and 34, which are located between part 310 and cover 320 of the cassette frame, are connected in driving relationship by an endless rubber belt (not shown), so that they rotate together.

Figure 7:
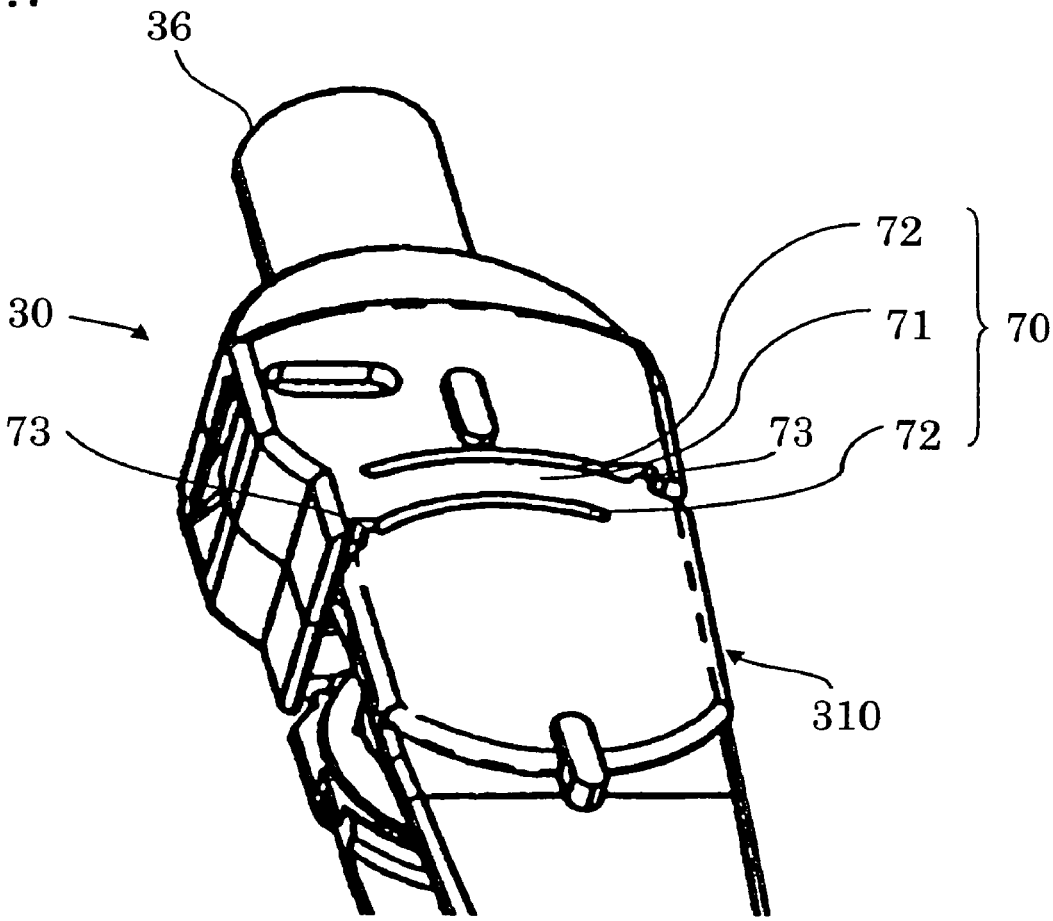
FIG. 7 is an enlarged, fragmentary perspective view of the portion of the case in the vicinity of the inter-axis distance shortening mechanism.

As shown in the figures from FIGS. 5(*a*) to FIG. 7, the inter-axis distance shortening mechanism 70, comprises two parts, one on the cassette part 310, and the other on cassette cover 320. Each of these two parts is composed of a pair of slots 72 in closely spaced, generally parallel, relationship. Each slot is open at one end, and one of the slots extends from one edge of the part 310 or cover 320, and the other slot extending from the opposite edge. The slots are thereby disposed on opposite sides of an elastically deformable part 71. There are two such elastically deformable parts in the cassette frame, one being a unitary part of the cassette part 310, and the other being a unitary part of the cover 320. As will be apparent, the slots 72 and the deformable part 71 on the cassette part 310 make it possible for the cassette part 310 to be shortened and lengthened slightly. Likewise, the slots and the deformable part on the cover 310 make it possible for the cover to be shortened and lengthened slightly. When the cassette is assembled by engagement of the cover with the part 310, both parts of the inter-axis distance shortening mechanism 70 are situated between supply reel and the take up reel. Thus the supply reel and the take-up reel are disposed respectively on two different parts of the cassette frame which are movable relative to each other by virtue of the deformable parts 71.

When the transfer tool is in use, the proximal end of the cassette bears against the rotating member 40 (FIG. 4(*a*)), which, in turn, bears against the teeth 63 inside the cylindrical guide. Consequently, the application of pressure through the transfer head to a receiving surface produces a reaction force tending to shorten the cassette and thereby shorten the distance between the axes of the supply and take-up reels. Shortening the inter-axis distance between the supply and take-up reels reduces the tension on the belt, while pressure is applied to the transfer tape by the transfer head, and allows the tape to be drawn off the supply reel more easily.

In the initial stage of use of a tape cassette, the outer diameter of the transfer tape 32 on the supply reel 33 is relatively large. Only a moderate tensile force is exerted on the transfer tape 32, and it can be drawn off the supply reel easily. Consequently, when pressing the transfer head 31 on a receiving surface to transfer the coating film, only a small pressing force is needed. The pressing force does not need to be enough to cause elastic deformation of the deformable parts 71 of the cassette. However, as transfer tape 32 is drawn from the supply reel 33 over time, the outer diameter of the transfer tape on the supply reel decreases, and more force is required to draw the transfer tape from the supply reel.

When a user presses the transfer head 31 on a receiving surface, the grooves 72 become narrower, and the deformable parts 71 bend, reducing the inter-axis distance between the supply reel 330 and the take-up reel 340. When the inter-axis distance decreases, the tensile force acting on the rubber belt decreases, and the friction between the rubber belt and its pulleys also decreases. Consequently, the slip torque, at the time when the rubber belt begins to slip on the take-up reel pulley, falls. Therefore the increase in tension in the length of tape extending from the supply reel to the transfer head as the tape supply is depleted is prevented, or at least reduced. Even in the later stages of use of the transfer tool, the transfer tape 32 can be drawn from the supply reel with a relatively small force.

As shown in FIGS. 5(*a*) 6(*a*), and 7, stops 73 can be provided at the open ends of the slots in order to prevent the slip torque between the belt and the take-up reel pulley from falling to a level at which the take-up reel fails.

Various modifications can be made to the coating film transfer tool described. For example, the configuration of the case body 11, the case cover 12 and the cassette 30, and of the inter-axis distance shortening mechanism can be varied. The number of projections 41 on the rotating member 40 and the numbers of teeth 52 and 63 on the push-button and on the interior of the cylindrical guide, can also be changed. These, and numerous other modifications can be made without departing from the scope of the invention as defined in the following claims.

What is claimed is:

1. A coating film transfer tool comprising:

a cassette having a supply reel for holding a supply of transfer tape composed of a base tape having a coating film thereon, a transfer head for pressing against said base tape to transfer the coating film from the base tape to a receiving surface, a take-up reel for winding the base tape after the coating film has been transferred therefrom, and means interconnecting the supply and take-up reels and driving the take-up reel in a direction to wind base tape thereon as transfer tape is unwound from the supply reel;

a case containing said cassette, the case having a forward end and a rear end, and the cassette being movable, when contained in the case, both forward and rearward along a longitudinal direction extending from the forward end to the rear end of the case, the forward end of the case having an opening through which the transfer head can protrude when the cassette is moved forward, and into which the transfer head can be withdrawn when the cassette is moved rearward;

means biasing the cassette rearward;

a push button protruding from the rear end of the case;

means, operable by depression of said push button, for moving the cassette forward and latching the cassette in a first position in which the transfer head protrudes through said opening, and for allowing the biasing means to move the cassette to a second position, in which the transfer head is withdrawn into said opening, said cassette being movable to first and second positions respectively by alternate depressions of the push button;

wherein said supply and take-up reels are rotatable, on said cassette, on spaced axes, wherein said interconnecting and driving means comprises an endless belt extending from the supply reel to the take-up reel, the belt being in tension and in driven relationship with the supply reel and in driving relationship with the take-up reel, and means for allowing the spacing of said axes to be shortened by a reaction force in reaction to pressure applied by said transfer head, through said transfer tape, to a receiving surface, whereby, when the spacing of said axes is shortened, tension in said belt is reduced.

2. A coating film transfer tool according to claim 1, wherein said cassette comprises a support frame, the supply and take-up reels are mounted on different parts of said support frame, and said parts of the support frame are connected by at least one deformable elastic member, whereby the spacing of said axes is shortened by elastic deformation of said deformable elastic member.

3. A coating film transfer tool according to claim 2, wherein said cassette is replaceable.

4. A coating film transfer tool according to claim 3, wherein said cassette is approximately symmetrical in a widthwise direction perpendicular to said longitudinal direction.

5. A coating film transfer tool according to claim 1, wherein said cassette is replaceable.

6. A coating film transfer tool according to claim 5, wherein said cassette is approximately symmetrical in a widthwise direction perpendicular to said longitudinal direction.

* * * * *